US009662890B2

(12) United States Patent
Dan

(10) Patent No.: US 9,662,890 B2
(45) Date of Patent: May 30, 2017

(54) LIQUID STORAGE APPARATUS AND CONTROL METHOD THEREOF

(71) Applicant: Kenichi Dan, Nagoya (JP)

(72) Inventor: Kenichi Dan, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 327 days.

(21) Appl. No.: 13/954,585

(22) Filed: Jul. 30, 2013

(65) Prior Publication Data

US 2014/0034140 A1 Feb. 6, 2014

(30) Foreign Application Priority Data

Jul. 31, 2012 (JP) ..... 2012-169707

(51) Int. Cl.
*B41J 2/175* (2006.01)

(52) U.S. Cl.
CPC ..... *B41J 2/17506* (2013.01); *B41J 2/17509* (2013.01); *B41J 2/17566* (2013.01); *B41J 2/175* (2013.01); *B41J 2002/17576* (2013.01); *Y10T 137/0324* (2015.04); *Y10T 137/7287* (2015.04); *Y10T 137/7358* (2015.04)

(58) Field of Classification Search
CPC ..... B41J 2/175; Y10T 137/7358; Y10T 137/7287
USPC ..... 137/2, 386, 409
See application file for complete search history.

(56) References Cited

U.S. PATENT DOCUMENTS

| | | | | |
|---|---|---|---|---|
| 6,378,971 | B1 | 4/2002 | Tamura et al. | |
| 6,390,611 | B1 * | 5/2002 | Kobayashi et al. | 347/84 |
| 2001/0024225 | A1 | 9/2001 | Ishizawa et al. | |
| 2002/0024543 | A1 | 2/2002 | Kimura et al. | |
| 2003/0071874 | A1 | 4/2003 | Ishizawa et al. | |
| 2004/0135829 | A1 * | 7/2004 | Yoshida | 347/7 |
| 2008/0303848 | A1 * | 12/2008 | Umeda | 347/6 |
| 2009/0315959 | A1 * | 12/2009 | Fukazawa et al. | 347/85 |
| 2010/0073438 | A1 * | 3/2010 | Wanibe et al. | 347/85 |
| 2010/0177148 | A1 * | 7/2010 | Asami | 347/85 |
| 2011/0199418 | A1 * | 8/2011 | Kaiho et al. | 347/17 |
| 2011/0242157 | A1 * | 10/2011 | Snyder | B41J 2/175 347/7 |
| 2011/0277303 | A1 * | 11/2011 | Mallory et al. | 29/447 |
| 2013/0187985 | A1 * | 7/2013 | Katoh et al. | 347/47 |

FOREIGN PATENT DOCUMENTS

JP 2001-232806 A 8/2001

* cited by examiner

*Primary Examiner* — Michael R Reid
*Assistant Examiner* — Christopher Ballman
(74) *Attorney, Agent, or Firm* — Baker Botts L.L.P.

(57) ABSTRACT

A sensing unit for detecting an amount of liquid stored in a storage chamber is configured so that: a direction of a first moment which is a moment about a shaft produced by self weights of a rotating member, a float, and a receiver is a direction in which the float is moved from a first position to a second position vertically below the first position; and a direction of a resultant moment obtained by combining a second moment, which is a maximum moment about the shaft produced when the receiver receives liquid supplied to the storage chamber, and the first moment is a direction in which the float is moved from the second position to the first position.

9 Claims, 8 Drawing Sheets

LIQUID STORAGE APPARATUS AND CONTROL METHOD THEREOF

CROSS REFERENCE TO RELATED APPLICATION

This application claims priority from Japanese Patent Application No. 2012-169707, which was filed on Jul. 31, 2012, the disclosure of which is herein incorporated by reference in its entirety.

BACKGROUND OF THE INVENTION

1. Field of the Invention

The present invention relates to a liquid storage apparatus which stores liquid and a control method thereof.

2. Description of Related Art

There has been known a liquid storage apparatus which includes: a sub-tank configured to temporarily store ink on the way to being supplied from a cartridge to a recording head; and a sensing unit configured to detect that a predetermined amount of ink has been stored in the sub-tank. The sensing unit may include: a rotating member configured to rotate about a shaft in the sub-tank; a float formed at a free end of the rotating member; a permanent magnet attached to the float; and an output generator which generates an electrical output corresponding to the number of magnetic lines of force produced by the permanent magnet, the number depending on the position of the float. The ink may be supplied from the cartridge to the sub-tank until it is determined that supply of the ink has been completed based on a detection result of the sensing unit.

SUMMARY OF THE INVENTION

The sensing unit can possibly break down due to a malfunction in a sensor included in the output generator, a malfunction in the rotation of the rotating member, or the like. If the sensing unit is broken, i.e., it is not normal in a liquid storage apparatus which fails to include an arrangement for determining whether the sensing unit is normal, it is impossible to detect whether the amount of ink stored in the sub-tank has reached its upper limit, and therefore ink could be excessively supplied from the cartridge to the sub-tank, resulting in an overflow of the ink from the sub-tank.

An object of the present invention is to provide a liquid storage apparatus and a control method thereof capable of determining whether a sensing unit is normal.

According to a first aspect of the present invention, there is provided a liquid storage apparatus comprising a storage chamber and a sensing unit. The storage chamber is configured to store liquid. The storage chamber includes: a supply opening which is formed on a wall defining the storage chamber and is configured to allow liquid supplied to the storage chamber to pass therethrough; and a discharge opening which is formed on a wall defining the storage chamber and is configured to allow liquid discharged from the storage chamber to an outside of the storage chamber to pass therethrough. The sensing unit is configured to detect an amount of liquid stored in the storage chamber. The sensing unit includes: a rotating member configured to rotate about a shaft in the storage chamber, the rotating member including a first arm extending in a first direction away from the shaft, and a second arm extending in a second direction which is away from the shaft and is different from the first direction; a float which is mounted on the first arm, and is configured to float on a surface of the liquid stored in the storage chamber; a receiver which is mounted on the second arm, and is configured to receive liquid supplied to the storage chamber through the supply opening; and a sensor configured to detect at least that the float is in a first position. The rotating member is configured to rotate about the shaft at least within a range between a rotational position corresponding to the float being in the first position and a rotational position corresponding to the float being in a second position which is vertically below the first position. The sensing unit is configured so that: (i) a direction of a first moment which is a moment about the shaft produced by self weights of the rotating member, the float, and the receiver is a direction in which the float is moved from the first position to the second position; and (ii) a direction of a resultant moment obtained by combining a second moment, which is a maximum moment about the shaft produced when the receiver receives liquid supplied to the storage chamber through the supply opening, and the first moment is a direction in which the float is moved from the second position to the first position.

According to a second aspect of the present invention, there is provided a method of controlling a liquid storage apparatus, the liquid storage apparatus comprising: a storage chamber configured to store liquid; and a sensing unit configured to detect an amount of liquid stored in the storage chamber. The storage chamber includes: a supply opening which is formed on a wall defining the storage chamber and is configured to allow liquid supplied to the storage chamber to pass therethrough; and a discharge opening which is formed on a wall defining the storage chamber and is configured to allow liquid discharged from the storage chamber to an outside of the storage chamber to pass therethrough. The sensing unit includes: a rotating member configured to rotate about a shaft in the storage chamber, the rotating member including a first arm extending in a first direction away from the shaft, and a second arm extending in a second direction which is away from the shaft and is different from the first direction; a float which is mounted on the first arm, and is configured to float on a surface of the liquid stored in the storage chamber; a receiver which is mounted on the second arm, and is configured to receive liquid supplied to the storage chamber through the supply opening; and a sensor configured to detect at least that the float is in a first position. The rotating member is configured to rotate about the shaft at least within a range between a rotational position corresponding to the float being in the first position and a rotational position corresponding to the float being in a second position which is vertically below the first position. The sensing unit is configured no that: (i) a direction of a first moment which is a moment about the shaft produced by self weights of the rotating member, the float, and the receiver is a direction in which the float is moved from the first position to the second position; and (ii) a direction of a resultant moment obtained by combining a second moment, which is a maximum moment about the shaft produced when the receiver receives liquid supplied to the storage chamber through the supply opening, and the first moment is a direction in which the float is moved from the second position to the first position. The sensing unit is configured to cause the receiver to be positioned vertically above the surface of the liquid stored in the storage chamber when the float is positioned in the first position by the liquid stored in the storage chamber. The method comprises the steps of: (a) determining that the sensing unit is normal when the sensor detects that the float is in the first position in response to an operation in which a necessary amount of liquid is supplied to the storage chamber through the supply opening in a state where the sensor is not detecting that the float is in the first position, the necessary amount being an amount needed to produce the second moment; and (b) determining that the sensing unit is not normal when the sensor does not detect that the float is in the first position in response to the operation.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes preferred embodiments of the present invention, with reference to the drawings.

(First Embodiment)

First, with reference to FIGS. 1 to 4, description will be made for an ink-jet printer including a liquid storage apparatus of a first embodiment of the present invention.

Figure 1:
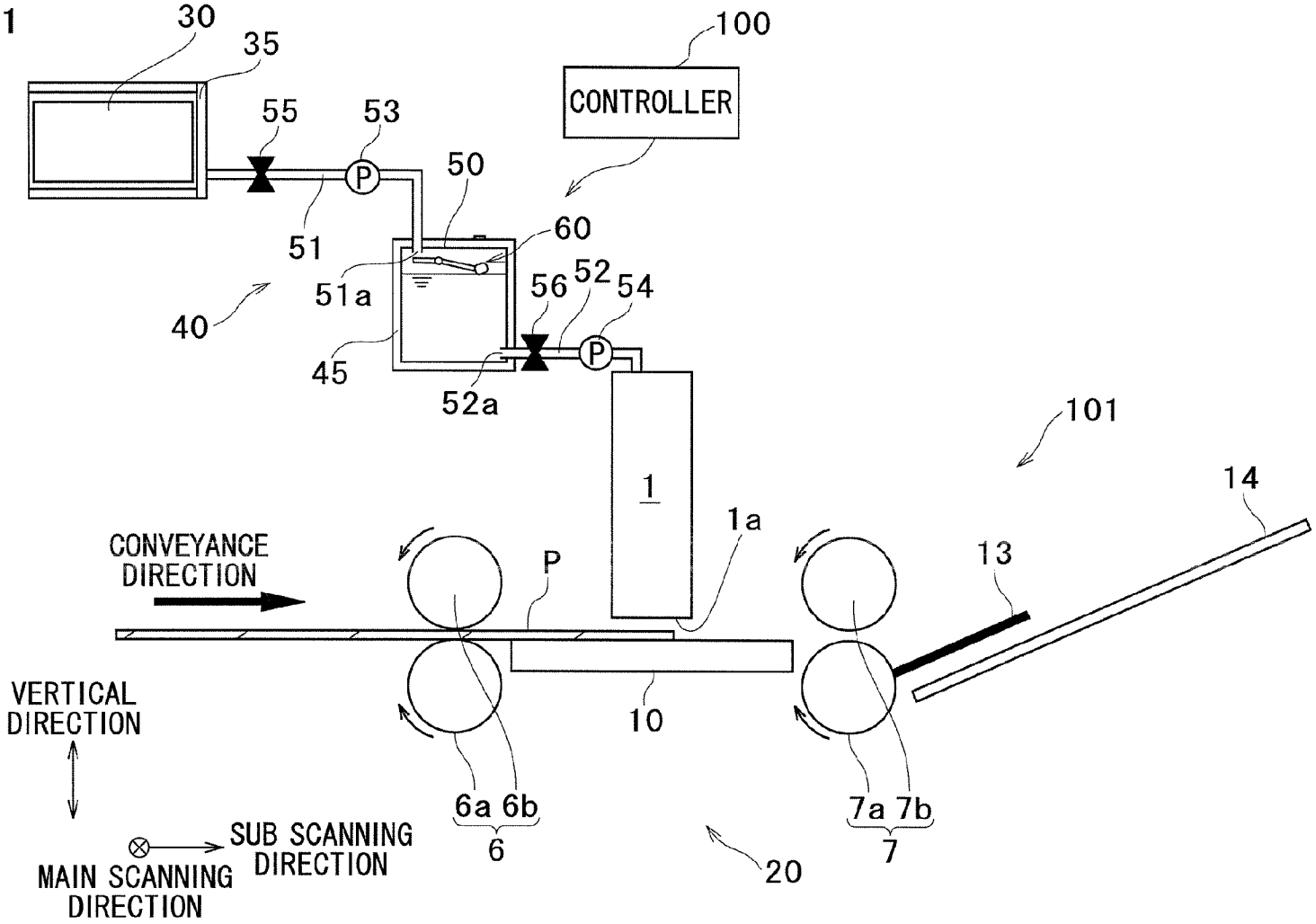
FIG. 1 is a schematic side view of an ink-jet printer including a quid storage apparatus of a first embodiment of the present invention.

As shown in FIG. 1, the ink-jet printer 101 includes: a conveyor 20; an ink-jet head 1; a mounting portion 35; and a liquid storage apparatus 40. The conveyor 20 is configured to convey a sheet P which is a recording medium. The head 1 is configured to eject ink to a sheet P being conveyed by the conveyor 20. The mounting portion 35 is a portion where a cartridge 30 is mounted. The liquid storage apparatus 40 is configured to temporarily store ink on the way to being supplied from the cartridge 30 to the head 1.

The conveyor 20 is configured to convey a sheet P in a conveyance direction, which is front the left to the right in FIG. 1, and the conveyor 20 includes a first conveyor 6, a second conveyor 7, a platen 10, a peel plate 13, and a paper discharge tray 14. The first conveyor 6 includes: a pair of conveyance rollers 6*a* and 6*b;* and a drive motor (not shown) which drives the conveyance rollers 6*a* and 6*b* to rotate. The pair of conveyance rollers 6*a* and 6*b* are rotated by the drive motor in respective directions indicated by arrows in FIG. 1, and thereby, the conveyance rollers 6*a* and 6*b* convey a sheet P fed by a sheet feeder (not shown) in the conveyance direction while gripping the sheet P. The second conveyor 7 includes: a pair of conveyance rollers 7*a* and 7*b;* and a drive motor (not shown) which drives the conveyance rollers 7*a* and 7*b* to rotate. The conveyance rollers 7*a* and 7*b* are rotated by the drive motor in respective directions indicated by arrows in FIG. 1, and thereby, the conveyance rollers 7*a* and 7*b* receive the sheet P conveyed by the first conveyor 6, and convey it further in the conveyance direction while gripping the sheet P.

The head 1 extends in a main scanning direction, and is disposed between the first conveyor 6 and the second conveyor 7 in the conveyance direction. An under surface of the head 1 is an ejection surface 1*a* having ejection openings from which ink is ejected. A discharge tube 52 of the liquid storage apparatus 40 is attached to a top surface of the head 1 via a joint (not shown). Inside the head 1, there are formed passages through which ink supplied from the liquid storage apparatus 40 passes toward the ejection openings. The head 1 ejects ink from the ejection openings when a sheet P conveyed by the conveyor 20 passes immediately below the head 1. As a result, a desired image is recorded on the sheet P. The main scanning direction is a direction orthogonal to a sheet surface of FIG. 1. A sub scanning direction is a direction orthogonal to the main scanning direction and parallel to a horizontal surface.

The platen 10 is disposed between the first conveyor 6 and the second conveyor 7 in the conveyance direction and is opposed to the ejection surface 1*a*. The platen 10 supports, from below, a sheet P conveyed by the first conveyor 6 and the second conveyor 7. A gap suitable for recording an image is created between a top surface of the platen 10 and the ejection surface 1*a*. The peel plate 13 is located downstream from the second conveyor 7 in the conveyance direction, and the peel plate 13 peels the sheet P from outer circumferential surfaces of the conveyance rollers 7*a* and 7*b*. The sheet P having been peeled by the peel plate 13 from the outer circumferential surfaces of the conveyance roller 7*a* and 7*b* is placed on the paper discharge tray 14.

Figure 2A:
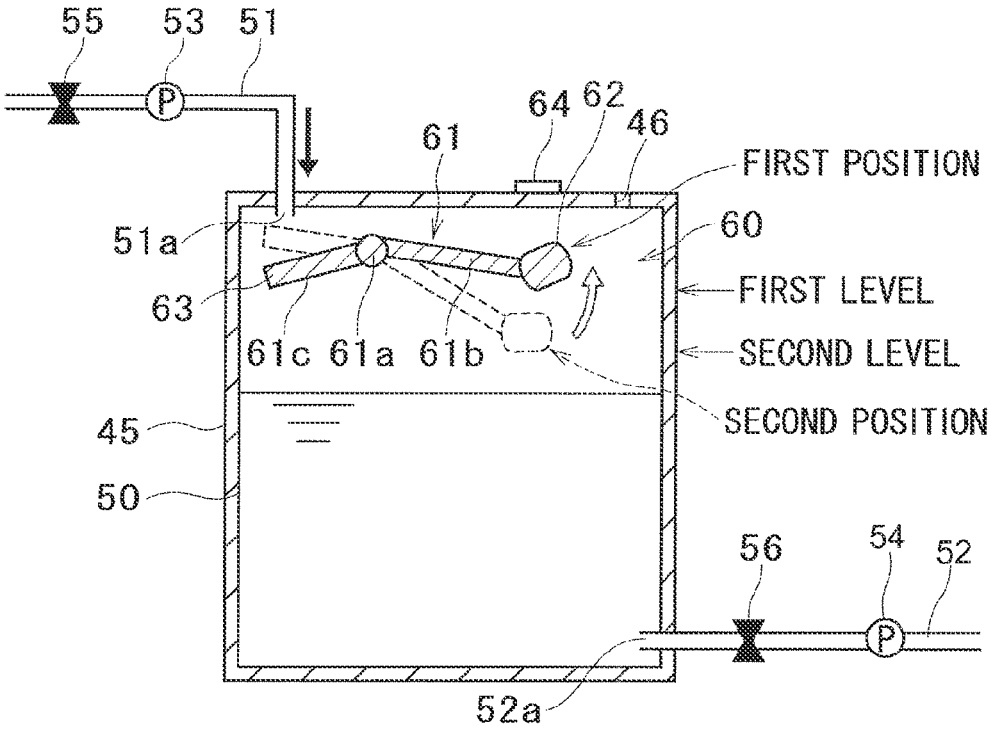
FIG. 2A is a schematic side view of the liquid storage apparatus shown in FIG. 1.

Next, the liquid storage apparatus 40 will be described. As shown in FIG. 2A, the liquid storage apparatus 40 includes a housing 45, a storage chamber 50, a supply tube 51, the discharge tube 52, a supply pump 53, a discharge pump 54, a supply valve 55, a discharge valve 56, a sensing unit 60, a display 95 (see FIG. 3), and a controller 100 (see FIG. 3). The controller 100 controls overall operation of the liquid storage apparatus 40.

The hollow storage chamber 50 is formed in the housing 45. The housing 45 defines the storage chamber 50. The storage chamber 50 is configured to temporarily store ink on the way to being supplied to the head 1. An air communication hole 46 which causes the inside of the storage chamber 50 to communicate with the air is formed on a top wall of the housing 45.

One end of the supply tube 51 is connected to the cartridge 30 which is mounted in the mounting portion 35. At the other end of the supply tube 51, a supply opening 51*a* is formed. The supply opening 51*a* is formed on the top wall of the housing 45, which wall defines the storage chamber 50, and the supply opening 51*a* is configured to allow ink supplied from the cartridge 30 to the storage chamber 50 to pass therethrough.

A discharge opening 52*a* is formed at one end of the discharge tube 52. The other end of the discharge tube 52 is connected to the joint of the head 1. The discharge opening 52*a* is formed on a lower portion of a side wall of the housing 45, which wall defines the storage chamber 50. The discharge opening 52*a* is configured to allow ink discharged from the storage chamber 50 to the outside of thereof, i.e., to the head 1 to pass therethrough.

The supply pump 53 and the supply valve 55 are provided to the supply tube 51, and they are controlled by the controller 100. In the state where the cartridge 30 is mounted in the mounting portion 35, when the supply pump 53 is driven with the supply valve 55 open under the control of the controller 100, ink stored in the cartridge 30 is transported to the supply opening 51*a* via the supply tube 51 at a predetermined transportation speed, and the ink is supplied to the storage chamber 50 through the supply opening 51*a*.

The discharge pump 54 and the discharge valve 56 are provided to the discharge tube 52, and they are controlled by the controller 100. When the discharge pump 54 is driven with the discharge valve 56 open under the control of the controller 100, ink stored in the storage chamber 50 is discharged through the discharge opening 52*a*. The ink having been discharged through the discharge opening 52*a* is supplied to the head 1 via the discharge tube 52. As a modification, instead of providing the pump and the valve to the discharge tube 52, a negative pressure may be created in the passages of the head 1, by means of which the ink stored in the storage chamber 50 is supplied to the head 1 via the discharge opening 52*a* and the discharge tube 52.

Next, the sensing unit 60 will be described. The sensing unit 60 is configured to detect the amount of ink stored in the storage chamber 50. As shown in FIG. 2A, the sensing unit 60 includes a rotating member 61, a float 62, a receiver 63, and a sensor 64. The rotating member 61, the float 62, and the receiver 63 are provided in the storage chamber 50. The sensor 64 is provided on an outer surface of the top wall of the housing 45.

The rotating member 61 is configured to rotate about a shaft 61*a*. The rotating member 61 includes: a first arm 61*b* extending in a first direction away from the shaft 61*a;* and a second arm 61*c* extending in a second direction which is away from the shaft 61*a* and is different from the first direction.

The float 62 is mounted on an end of the first arm 61*b*, which end is opposite to the shaft 61*a*. The float 62 is configured to float on the surface of the ink stored in the storage chamber 50. A magnetic material is included in an upper portion of the float 62. The sensing unit 60 further includes a stopper (not shown) which restricts the rotation of the rotating member 61 within a predetermined range. Due to the stopper, the rotating member 61 is allowed to rotate about the shaft 61*a* only within the range between a rotational position corresponding to the float 62 being in a first position and a rotational position corresponding to the float 62 being in a second position. In this rotation, the first anti 61*b* and the second arm 61*c* are moved integrally with each other. The first position is a position vertically below an upper end of the storage chamber 50. The second position is a position vertically below the first position and vertically above a vertical center of the storage chamber 50.

Hereinafter, description will be made using the following terms for the level of the ink stored in the storage chamber 50: as shown in FIG. 2A, a vertically lowest level among levels at which the ink causes the float 62 to float in the first position by buoyancy exerted thereto is referred to as a "first level"; and a vertically lowest level among levels at which the ink exerts buoyancy to the float 62 in the second position is referred to as a "second level".

The receiver 63 is mounted on an end of the second arm 61*c*, which end is opposite to the shaft 61*a*. The receiver 63 is configured to receive ink supplied to the storage chamber 50 through the supply opening 51*a*. The receiver 63 is formed integrally with the rotating member 61. As shown in FIG. 2A, the receiver 63 is positioned vertically below the supply opening 51*a*. Therefore, the ink supplied to the storage chamber 50 through the supply opening 51*a* collides with the receiver 63 before reaching the surface of the ink stored in the storage chamber 50. In this embodiment, the receiver 63 has a flat plate shape. The ink having collided with the receiver 63 heads toward the surface of the ink stored in the storage chamber 50, without remaining on the receiver 63. The receiver 63 is positioned vertically above the shaft 61*a* when the float 62 is in the second position. Therefore, when the float 62 is in the second position, at least a part of the ink having collided with the receiver 63 reaches the shaft 61*a*. With this, ink adhered to the shaft 61*a* is flushed away, and its viscosity is decreased. This decreases the possibility that a malfunction in the rotation of the rotating member 61 occurs due to the ink adhered thereto.

The sensor 64 is a magnetic sensor which detects the magnetic material included in the float 62. The sensor 64 outputs an ON signal to the controller 100 only when die float 62 is in the first position.

A combined center of gravity obtained by combining the respective centers of gravity of the rotating member 61, the float 62, and the receiver 63 is positioned between the shaft 61*a* and the float 62, that is, at the right of the shaft 61*a* in FIG. 2A. Thus, the direction of a resultant rotation moment obtained by combining respective rotation moments about the shaft 61*a* caused by the self weights of the rotating member 61, the float 62, and the receiver 63 is a direction in which the float 62 is moved from the first position to the second position, that is, a clockwise direction in FIG. 2A. This resultant rotation moment is referred to as a "first moment". When the supply pump 53 is not driven and ink is not supplied to the storage chamber 50 through the supply opening 51*a*, a rotation moment caused about the shaft 61*a* is the first moment only. Therefore, when the level of the ink stored in the storage chamber 50 is vertically below the second level, the float 62 is always in the second position. When the level of the ink stored in the storage chamber 50 is vertically above the second level but vertically below the first level, the float 62 contacts the surface of the ink, and thereby buoyancy is exerted to the float 62, with the result that the float 62 follows the surface. When the level of the ink stored in the storage chamber 50 is vertically above the first level, the float 62 is always in the first position.

When the supply pump 53 is driven and ink is supplied to the storage chamber 50 through the supply opening 51*a*, the ink collides with the receiver 63, and the receiver 63 receives kinetic energy of the ink, i.e., energy produced by the collision. The kinetic energy produces a rotation moment about the shaft 61*a* in a direction in which the float 62 is moved from the second position to the first position, that is, a counterclockwise direction in FIG. 2A. This rotation moment is referred to as a "kinetic moment".

Figure 2B:
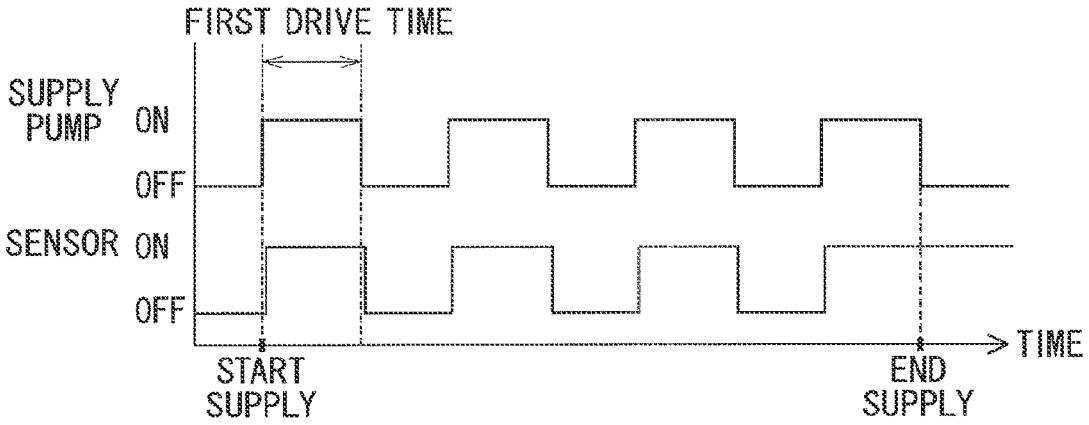
FIG. 2B is a diagram showing a relation between driving of a supply pump and a detection result of a sensor.

The sensing unit 60 is configured so that, regardless of the position of the rotating member 61, the magnitude of the kinetic moment at the time of supply, which will be described later, is always larger than the magnitude of the first moment, by adjusting the distance between the receiver 63 and the shaft 61*a*, the position of the combined center of gravity, an amount of ink transported by the supply pump 53, or the like. In other words, the sensing unit 60 is configured so that the direction of a resultant moment obtained by combining the first moment and the kinetic moment is the direction in which the float 62 is moved from the second position to the first position, that is, the counterclockwise direction in FIG. 2A. In this embodiment, the receiver 63 is configured to be always positioned vertically above the surface of the ink stored in the storage chamber 50. Therefore, when ink is supplied to the storage chamber 50 through the supply opening 51*a*, the kinetic moment is always produced about the shaft 61*a*. As a result, when the supply pump 53 is driven and ink is supplied to the storage chamber 50 through the supply opening 51*a*, the rotating member 61 rotates in the direction in which the float 62 is moved from the second position to the first position, and thereby the float 62 is positioned in the first position, so that the ON signal is output from the sensor 64 as shown in FIG. 2B. In this embodiment, the kinetic moment corresponds to a second moment of the present invention.

Figure 3:
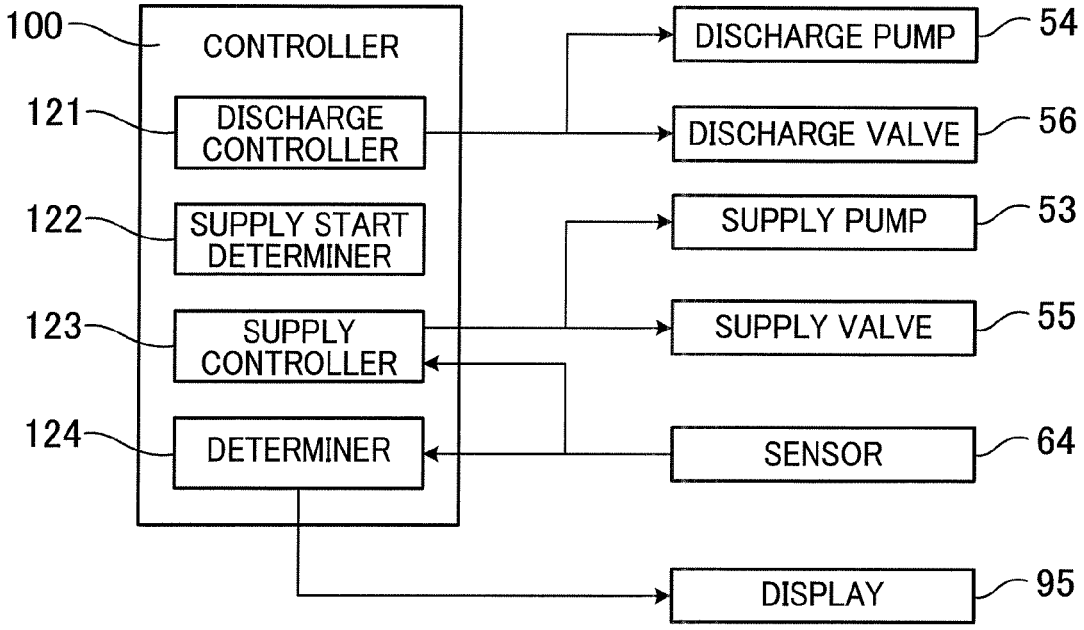
FIG. 3 is a functional block diagram of a controller of the liquid storage apparatus shown in FIG. 1.

Next, the controller 100 will be described with reference to FIGS. 2B and 3. The controller 100 includes: a CPU (Central Processing Unit); a ROM (Read Only Memory) which rewritably stores programs executed by the CPU and data used in these programs; a RAM (Random Access Memory) which temporarily stores data at the time of execution of a program; and a nonvolatile Memory. Each of function units constituting the controller 100 is constructed by the hardware and software stored in the ROM which cooperate with each other. As shown in FIG. 3, the function units are a discharge controller 121, a supply start determiner 122, a supply controller 123, a determiner 124, and the like.

The discharge controller 121 controls the discharge pump 54 and the discharge valve 56 to perform an operation of discharging the ink stored in the storage chamber 50 through the discharge opening 52*a* to supply it to the head 1. Hereinafter, this operation is referred to as "discharge".

The supply start determiner 122 determines whether to start an operation of supplying ink from the cartridge 30 to the storage chamber 50. Hereinafter, this operation is referred to as "supply". To be more specific, the supply start determiner 122 obtains an approximate level of the ink stored in the storage chamber 50 based on details of the discharge performed after the previous supply, for example, based on a period of time during which the discharge pump 54 is driven. Such a period is simply referred to as a "drive time". Then, the supply start determiner 122 determines not to start the supply when the obtained level is the same as or vertically above a predetermined level, whereas the supply start determiner 122 determines to start the supply when the obtained level is vertically below the predetermined level. The predetermined level is vertically below the second level.

The supply controller 123 controls the supply pump 53 and the supply valve 55 to perform the supply when the supply start determiner 122 determines to start the supply. In this embodiment, the supply controller 123 intermittently drives the supply pump 53 to intermittently supply ink to the storage chamber 50 until the level of the ink stored in the storage chamber 50 reaches the first level. To be more specific, as shown in FIG. 2B, the supply controller 123 continues the supply until the ON signal is output from the sensor 64 despite the fact that ink is not supplied in this intermittent supply. An amount of ink supplied in each of supply operations constituting the intermittent supply is set to be equal to or less than "an amount of ink required to raise the level of the ink stored in the storage chamber 50 from the first level to an upper end of the storage chamber 50". With this, even if the supply is started in the state where the level of the ink stored in the storage chamber 50 is slightly vertically below the first level, an overflow of the ink from the storage chamber 50 is prevented since the level of the ink stored in the storage chamber 50 is never raised to the upper end of the storage chamber 50. Further, the amount of ink supplied in each of supply operations constituting the intermittent supply is set to be equal to or more than a "necessary amount". The "necessary amount" is an amount of ink required to produce the kinetic moment about the shaft 61*a*, which kinetic moment has a larger magnitude than that of the first moment.

When the determiner 124 determines that the sensing unit 60 is not normal during the supply, the supply controller 123 stops driving the supply pump 53, to stop the supply. In this embodiment, the supply controller 123 and the supply pump 53 correspond to a supplier of the present invention.

The determiner 124 determines whether the sensing unit 60 is normal. The sensing unit 60 can possibly break down due to a malfunction in the sensor 64, a malfunction in the rotation of the rotating member 61, or the like. When the sensing unit 60 breaks down, that is, the sensing unit 60 is not normal, it is impossible to detect whether the level of the ink stored in the storage chamber 50 has reached the first level, and thereby ink could be excessively supplied to the storage chamber 50, with the result that the ink overflows from the storage chamber 50 through the air communication hole 46 or the like. Therefore, the determiner 124 determines that the sensing unit 60 is normal when the ON signal from the sensor 64 is received in response to an operation in which the supply pump 53 is driven to supply ink to the storage chamber 50 in the state where the sensor 64 is not outputting the ON signal; whereas, the determiner 124 determines that the sensing unit 60 is not normal when the ON signal from the sensor 64 is not received in response to the operation. When the determiner 124 determines that the sensing unit 60 is not normal, the determiner 124 controls the display 95 so as to display thereon an image notifying a user that the sensing unit 60 is not normal. In this embodiment, it is assumed that, when the determiner 124 determines that the sensing unit 60 is normal at the time of starting the supply, the sensing unit 60 operates normally during that supply, and the above determination is made only once in one operation of the supply.

Figure 4:
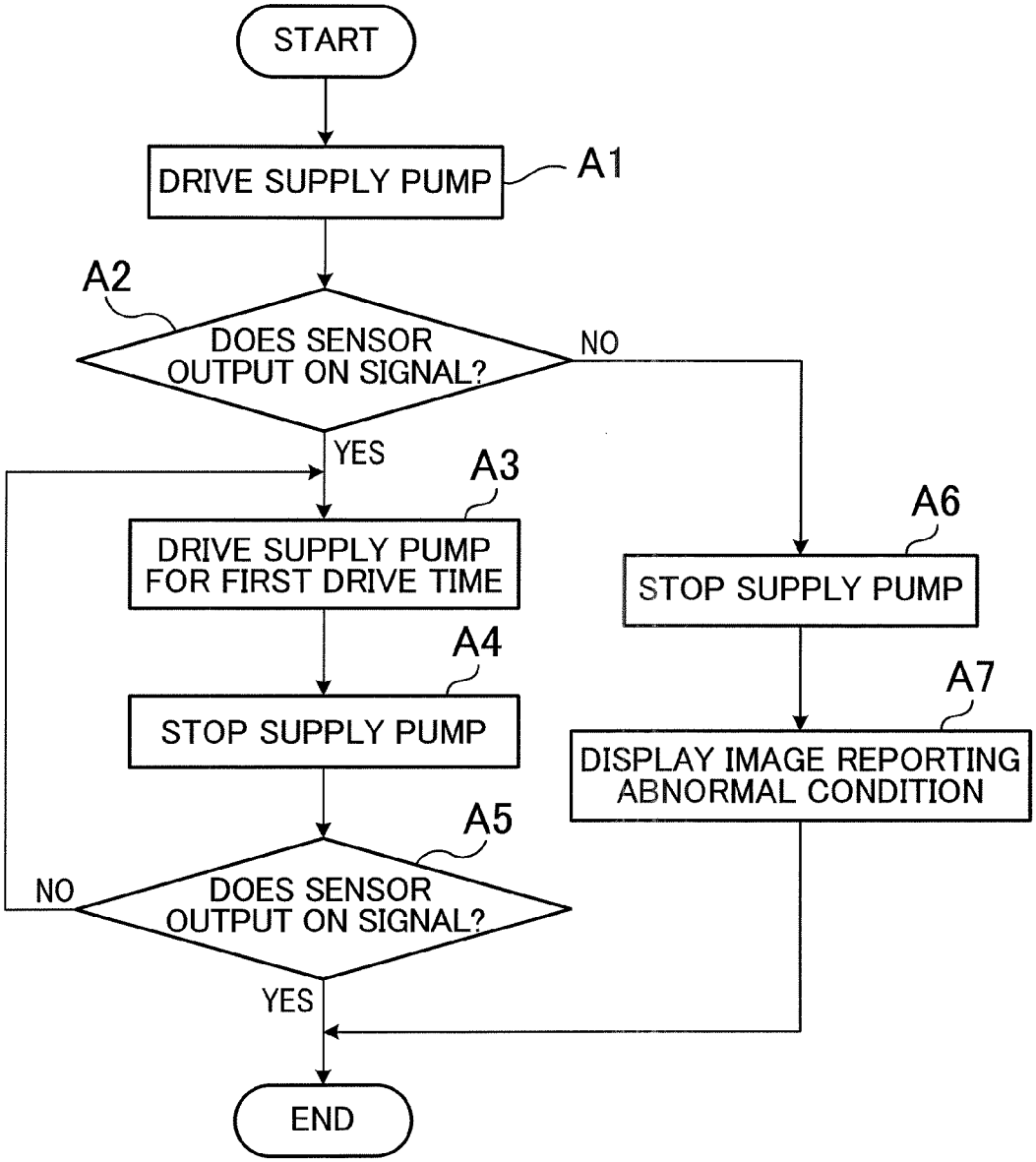
FIG. 4 is an operation flow chart of the controller of the liquid storage apparatus shown in FIG. 1.

Next, with reference to FIG. 4, description will be made for one example of operations of the liquid storage apparatus 40. The time point of the start of the operation flow of FIG. 4 is after the supply start determiner 122 determines to start the supply, and before the supply controller 123 starts the supply. In addition, at the time of the start, the controller 100 has not received the ON signal from the sensor 64 yet.

As shown in FIG. 4, first, the supply controller 123 drives the supply pump 53 with the supply valve 55 open, to start the supply (A1). With this, ink is supplied to the storage chamber 50 through the supply opening 51*a*. Then, when the sensing unit 60 is normal, the rotating member 61 rotates to the rotational position corresponding to the float 62 being in the first position.

Next, the determiner 124 determines whether the ON signal from the sensor 64 has been received (A2). When the determiner 124 determines that the ON signal from the sensor 64 has been received (A2: YES), the determiner 124 determines that the sensing unit 60 is normal. Then, the supply controller 123 drives the supply pump 53 for a first drive time (see FIG. 2B) so that a predetermined amount of ink is supplied (A3), and then stops the supply pump 53 (A4). Next, the determiner 124 determines whether the ON signal from the sensor 64 is received even when the supply pump 53 is stopped (A5). When the determiner 124 determines that the ON signal from the sensor 64 is not received (A5: NO), the determiner 124 determines that the level of the ink stored in the storage chamber 50 is vertically below the first level, and returns the processing to A3 so that the supply is continued. When the determiner 124 determines that the ON signal from the sensor 64 is received (A5: YES), the determiner 124 determines that the level of the ink stored in the storage chamber 50 has reached the first level, and makes control to end the supply, and this processing ends.

When the determiner 124 determines that the ON signal from the sensor 64 has not been received (A2: NO), the determiner 124 determines that the sensing unit 60 is not normal. Then, the supply controller 123 stops the supply pump 53, to stop the supply (A6). Next, the determiner 124 controls the display 95 so as to display thereon an image notifying a user that the sensing unit 60 is not normal (A7), and this processing ends.

As described above, in this embodiment, when ink is supplied to the storage chamber 50 through the supply opening 51*a*, the kinetic moment is produced about the shaft 61*a* in the direction in which the float 62 is moved from the second position to the first position. With this, the float 62 is moved vertically upward to be positioned in the first position, as long as there is no malfunction in the rotation of the rotating member 61. Therefore, when the sensor 64 detects that the float 62 is in the first position in response to the production of the kinetic moment, it is determined that there is no trouble in the sensor 64 and the sensing unit 60 is normal.

In the first embodiment, the receiver 63 is never positioned vertically below the surface of the ink stored in the storage chamber 50. Therefore, when the necessary amount of ink is supplied to the storage chamber 50 through the supply opening 51*a*, the receiver 63 receives the ink, and the kinetic moment is always produced about the shaft 61*a*. Accordingly, the determiner 124 determines that the sensing unit 60 is not normal when the sensor 64 does not detect that the float 62 is in the first position in response to the operation in which the necessary amount of liquid is supplied to the storage chamber 50 through the supply opening 51*a* in the state where the sensor is not detecting that the float 62 is in the first position. With this, whether the sensing unit 60 is normal is determined accurately.

(Second Embodiment)

The following describes a liquid storage apparatus 40 of a second embodiment of the present invention, with reference to FIGS. 5A, 5B, 5C, and 6. The sensing unit 60 of the first embodiment is configured so that the receiver 63 is always positioned vertically above the surface of the ink stored in the storage chamber 50. On the other hand, a sensing unit 160 of the second embodiment is configured on that the receiver 63 is positioned vertically below the first level when the level of the ink stored in the storage chamber 50 is at the first level and the float is in the first position. Further, ink is intermittently supplied to the storage chamber 50 in the first embodiment, whereas ink is continuously supplied to the storage chamber 50 in the second embodiment. Hereinbelow, components same as those in the first embodiment are given the same reference numerals, and description thereof will be omitted if appropriate.

In this embodiment, when the level of the ink stored in the storage chamber 50 is raised above the second level, the rotating member 61 rotates in the direction in which the float 62 is moved from the second position to the first position, and the receiver 63 comes into contact with the surface of the ink stored in the storage chamber 50 before the float 62 reaches the first position. This decreases a rotation moment about the shaft 61*a* in the direction in which the float 62 is moved from the second position to the first position. The level of the ink stored in the storage chamber 50 could be further raised thereafter to a boundary level or a level vertically above the boundary level. In this case, even if ink whose amount is equal to or larger than the necessary amount is supplied to the storage chamber 50 through the supply opening 51*a*, the float 62 is not moved to the first position, and as a result, the sensor 64 stops outputting an ON signal as shown in FIG. 5B.

Figure 5A:
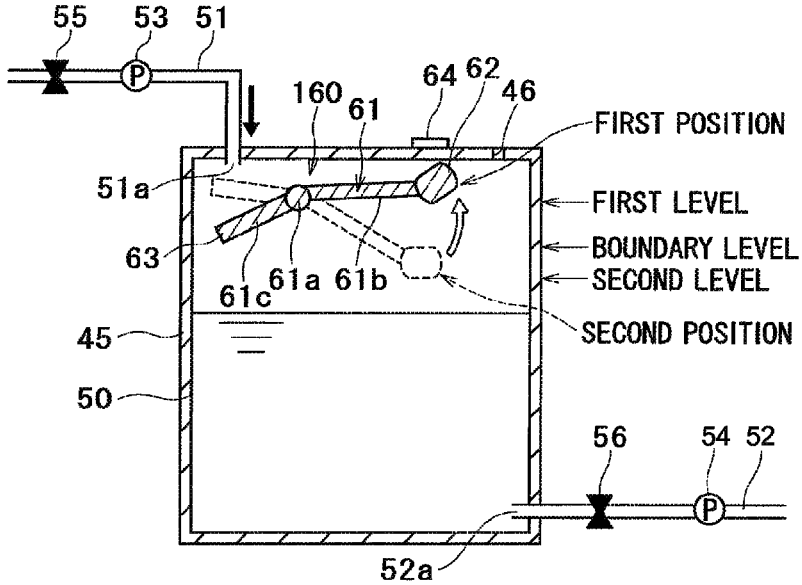
FIG. 5A is a schematic side view of a liquid storage apparatus of a second embodiment of the present invention.
Figure 5B:
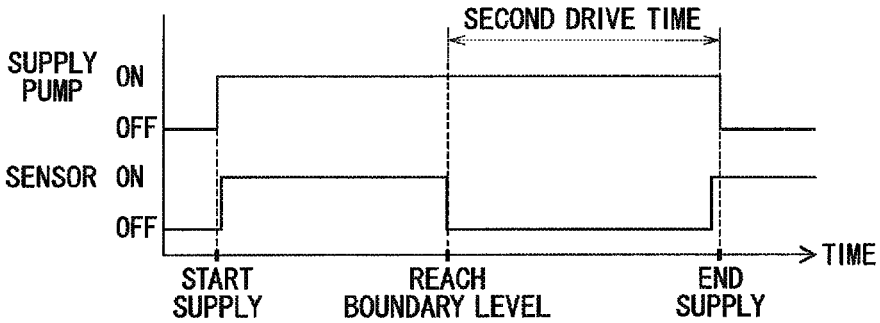
FIG. 5B is a diagram showing a relation between driving of the supply pump and a detection result of the sensor in the ease where the level of the ink stored in a storage chamber is vertically above a boundary level.
Figure 5C:
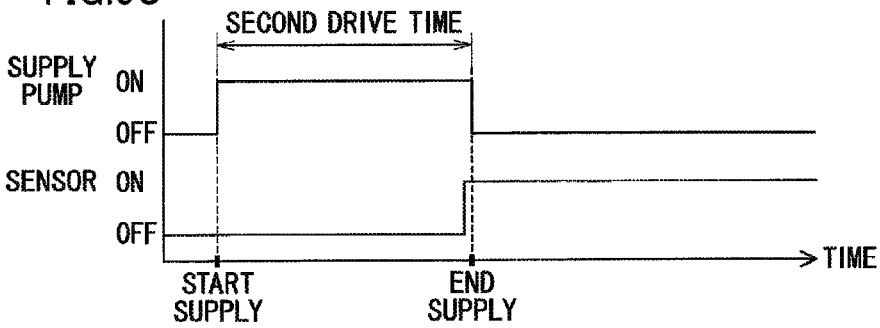
FIG. 5C is a diagram showing a relation between driving of the supply pump and a detection result of the sensor in the case where the level of the ink stored in the storage chamber is vertically below the boundary level.

When the sensing unit 160 is normal and the level of the ink stored in the storage chamber 50 is vertically below the boundary level at the time of starting the supply, the float 62 is moved to the first position, and the ON signal is output from the sensor 64, as shown in FIG. 5B. At this time, the determiner 124 determines that the sensing unit 160 is normal. However, even if the sensing unit 160 is normal, when the level of the ink stored in the storage chamber 50 is vertically above the boundary level at the time of starting the supply, the float 62 is not moved to the first position, so that the ON signal is not output from the sensor 64, as shown in FIG. 5C. Therefore the determiner 124 cannot determine that the sensing unit 160 is normal.

Therefore, in this embodiment, when the ON signal is not output from the sensor 64 despite the fact that ink whose amount is equal to or larger than the necessary amount has been supplied to the storage chamber 50 through the supply opening 51*a*, ink is kept supplied to the storage chamber 50 to identify its reason. The determiner 124 determines that the sensing unit 160 is normal when the ON signal from the sensor 64 is received before a drive time of the supply pump 53 measured from the start of the supply reaches a second drive time (see FIG. 5C); whereas, the determiner 124 determines that the sensing unit 160 is not normal when the ON signal from the sensor 64 is not received before that. As shown in FIG. 5B, the "second drive time" is a drive time of the supply pump 53 required to supply an amount ink to the storage chamber 50, which amount is needed to raise the level of the ink stored in the storage chamber 50 from the boundary level to the first level. This amount of ink is referred to as a "buffer amount".

In a liquid storage apparatus which does not determine whether the sensing unit is normal when the level of the ink stored in the storage chamber is vertically below the boundary level, a maximum amount of ink which is necessary to be supplied to the storage chamber to identify the reason why the ON signal is not output from the sensor is the amount of ink stored in the storage chamber whose level is the first level. Therefore, an excessive amount of ink could be supplied to the storage chamber.

On the other hand, in this embodiment, when the level of the ink stored in the storage chamber 50 is vertically below the boundary level, ink is kept supplied to the storage chamber 50 through the supply opening 51*a* and it is determined whether the sensing unit 160 is normal. Therefore, the maximum amount of ink which is necessary to be supplied to the storage chamber 50 to identify the reason why the ON signal is not output from the sensor 64 is the buffer amount. Consequently, the amount of ink supplied to the storage chamber 50 is smaller.

Figure 6:
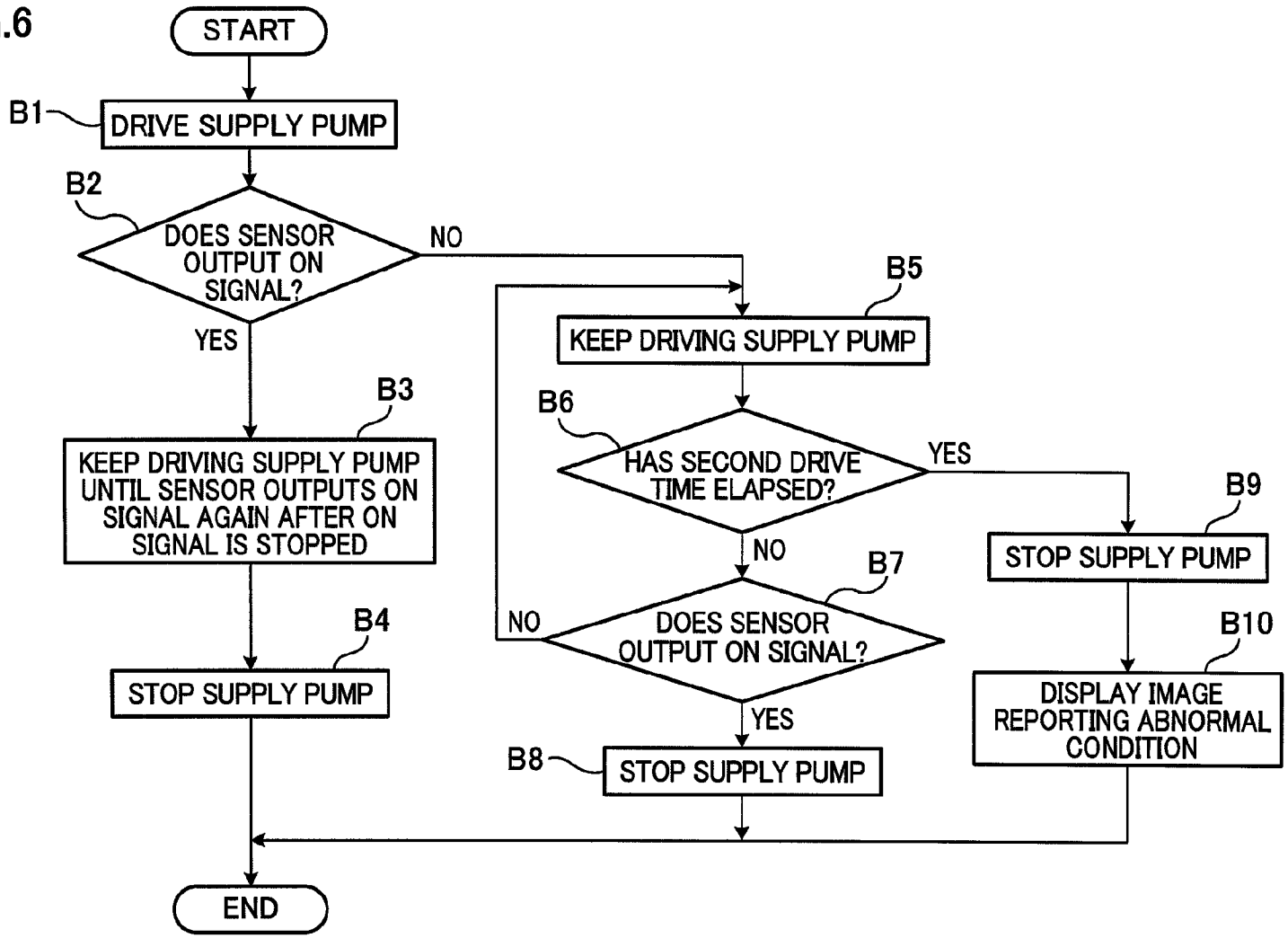
FIG. 6 is an operation flow chart of the liquid storage apparatus of the second embodiment of the present invention.

Next, with reference to FIG. 6, description will be made for one example of operations of the liquid storage apparatus 40. The time point of the start of the operation flow of FIG. 6 is after the supply start determiner 122 determines to start the supply, and before the supply controller 123 starts the supply. In addition, at the time of the start, the controller 100 has not received the ON signal from the sensor 64 yet.

As shown in FIG. 6, first, the supply controller 123 drives the supply pump 53 with the supply valve 55 open, to start the supply (B1). Next, the determiner 124 determines whether the ON signal from the sensor 64 has been received (B2). When it is determined that the ON signal from the sensor 64 has been received (B2: YES), the determiner 124 determines that the sensing unit 160 is normal. Then, the supply controller 123 keeps driving the supply pump 53 until the ON signal from the sensor 64 is received again after the ON signal from the sensor 64 is stopped (B3), and then, the supply controller 123 stops the supply pump 53 to end the supply (B4), and this processing ends.

When the determiner 124 determines that the ON signal from the sensor 64 has not been received (B2: NO), the supply controller 123 keeps driving the supply pump 53 (B5). Then, the determiner 124 determines whether the drive time of the supply pump 53 measured from the start of the supply has reached the second drive time (B6). When it is determined that the drive time has not reached the second drive time (B6: NO), the determiner 124 determines whether the ON signal from the sensor 64 has been received (B7). When it is determined that the ON signal from the sensor 64 has not been received (B7: NO), the determiner 124 returns the processing to B5. When it is determined that the ON signal from the sensor 64 has been received (B7: YES), the determiner 124 determines that the sensing unit 160 is normal. At this time, the level of the ink stored in the storage chamber 50 is raised to the first level or a level vertically above the first level. Therefore, the supply controller 123 stops the supply pump 53 to end the supply (B8), and this processing ends.

When it is determined that the drive time of the supply pump 53 measured from the start of the supply has reached the second drive time (B6: YES), the determiner 124 determines that the sensing unit 160 is not normal. Then, the supply controller 123 stops the supply pump 53 to stop the supply (B9). Next, the determiner 124 controls the display 95 so as to display thereon an image notifying a user that the sensing unit 160 is not normal (B10), and this processing ends.

As described above, in this embodiment, when the sensor 64 does not detect that the float 62 is in the first position even though the necessary amount of ink is supplied to the storage chamber 50 through the supply opening 51*a*, it is assumed that the receiver 63 may be vertically below the surface of the ink stored in the storage chamber 50, and ink is kept supplied to the storage chamber 50. Then, when the sensor 64 detects that the float 62 is in the first position before the amount of ink having supplied to the storage chamber 50 reaches the butler amount, it is determined that the sensing unit 160 is normal; whereas when the sensor 64 does not detect that the float 62 is in the first position before that, it is determined that the sensing unit 160 is not normal. With this, whether the sensing unit 160 is normal is accurately determined. Further, the buffer amount is smaller than the amount of ink stored in the storage chamber 50 when the float 62 is in the first position. Therefore, the amount of ink supplied to the storage chamber 50 is smaller.

Since ink is continuously supplied to the storage chamber 50 in this embodiment, the time required for the supply is shortened.

(Third Embodiment)

Figure 7A:
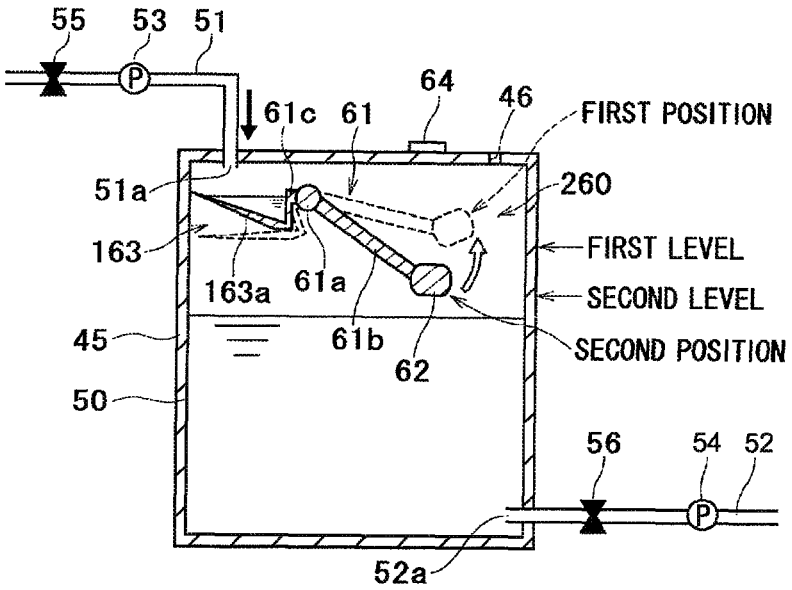
FIG. 7A is a schematic side view of a liquid storage apparatus of a third embodiment of the present invention.
Figure 7B:
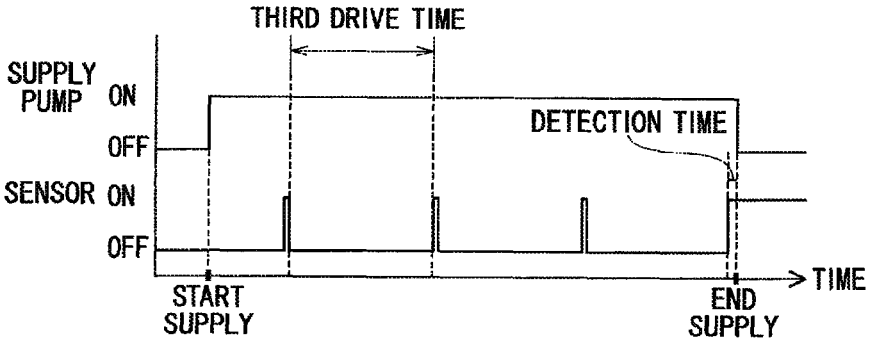
FIG. 7B is a diagram showing a relation between driving of the supply pump and a detection result of the sensor.
Figure 8:
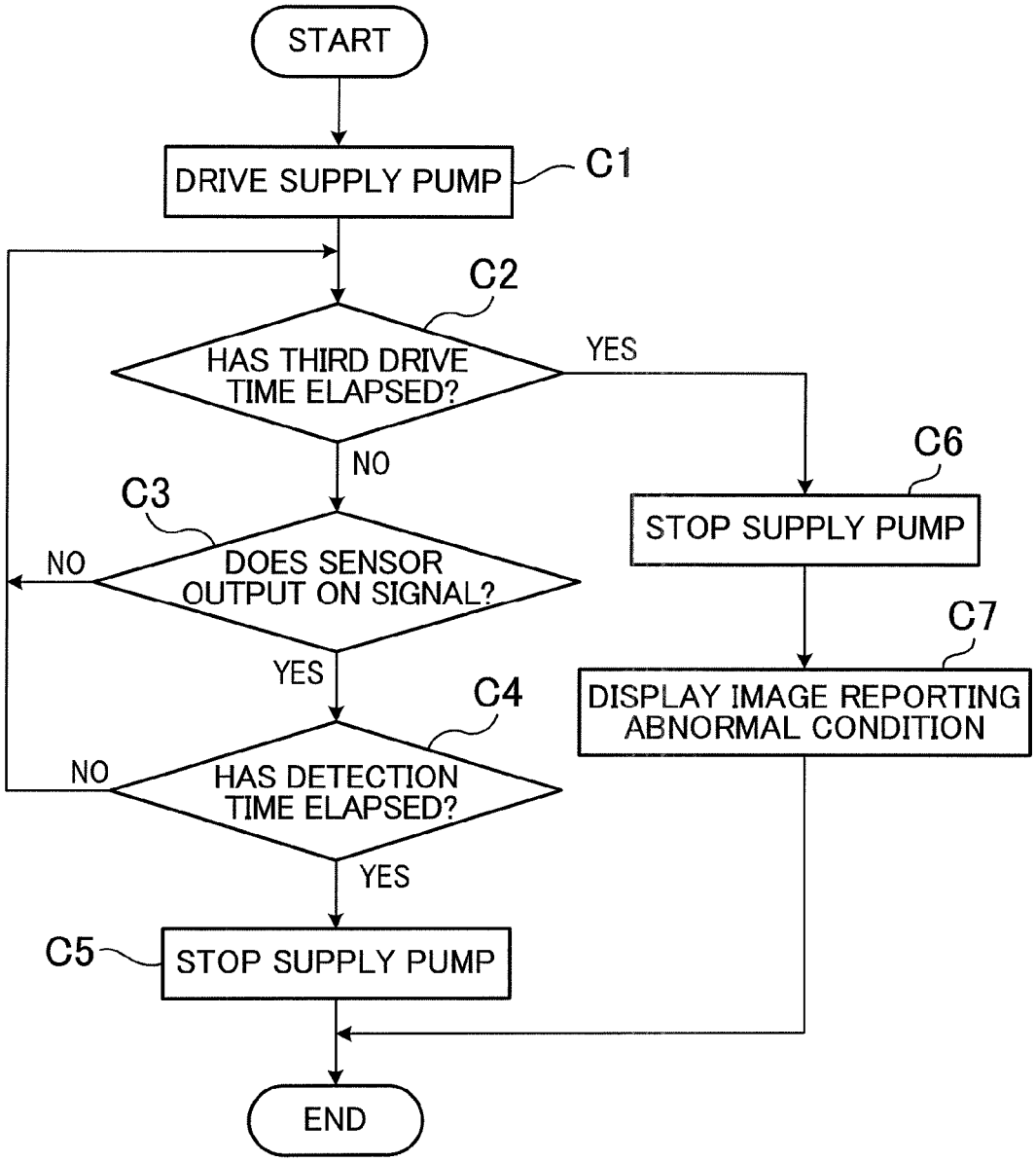
FIG. 8 is an operation flow chart of the liquid storage apparatus of the third embodiment of the present invention.

The following describes a liquid storage apparatus 40 of a third embodiment of the present invention, with reference to FIGS. 7A, 7B, and 8. The third embodiment is different from the first embodiment in that a receiver 163 of the third embodiment includes a storage portion 163*a* configured to temporarily store ink supplied to the storage chamber 50 through the supply opening 51*a*. Further, ink is intermittently supplied to the storage chamber 50 in the first embodiment, whereas ink is continuously supplied to the storage chamber 50 in the third embodiment. Hereinbelow, components same as those in the first embodiment are given the same reference numerals, and description thereof will be omitted if appropriate.

As shown in FIG. 7A, the receiver 163 includes the box-like storage portion 163*a* with an open top. The storage portion 163*a* is configured to temporarily store ink supplied to the storage chamber 50 through the supply opening 51*a* before the ink reaches the surface of the ink stored in the storage chamber 50. The receiver 163 is configured so that the ink stored in the storage portion 163*a* flows out of the storage portion 163*a* when the float 62 is in the first position. The ink having flowed out of the storage portion 163*a* heads toward the surface of the ink stored in the storage chamber 50. The storage portion 163*a* is configured to be always positioned vertically above the surface of the ink stored in the storage chamber 50.

As described above, in this embodiment, the self weight of the ink stored in the storage portion 163*a* also produces a rotation moment about the shaft 61*a* of the rotating member 61. This moment is referred to as a "self-weight moment". The direction of the self-weight moment is the direction in which the float 62 is moved from the second position to the first position, that is, the counterclockwise direction in FIG. 7A.

A sensing unit 260 of this embodiment is configured so that: regardless of the rotational position of the rotating member 61, the magnitude of the first moment is always larger than the magnitude of the kinetic moment; and the magnitude of the first moment is always smaller than the magnitude of a combined rotation moment obtained by combining the kinetic moment and the self-weight moment produced when a predetermined amount of ink is stored in the storage portion 163*a*. Therefore, when ink is supplied to the storage chamber 50 through the supply opening 51*a* but the predetermined amount of ink is not stored in the storage portion 163*a*, the rotating member 61 does not rotate, and the float 62 is away from the first position. Then, the supply is continued and when the predetermined amount of ink is stored in the storage portion 163*a*, the rotating member 61 rotates in the direction in which the float 62 is moved from the second position to the first position, with the result that the float 62 is positioned in the first position. With this, an ON signal is output from the sensor 64, as shown in FIG. 7B. Thereafter, the ink stored in the storage portion 163*a* flows out of the storage portion 163*a*. This decreases the magnitude of the self-weight moment, and therefore the rotating member 61 rotates in the direction in which the float 62 is moved from the first position to the second position, causing the float 62 to be away from the first position. As a result, the sensor 64 stops outputting the ON signal, as shown in FIG. 7B. In this embodiment, the combined rotation moment obtained by combining the kinetic moment and the self-weight moment produced when the predetermined amount of ink is stored in the storage portion 163*a* corresponds to the second moment of the present invention.

The determiner 124 of this embodiment determines that the sensing unit 260 is normal when the ON signal from the sensor 64 is received before the drive time of the supply pump 53 measured from the start of the supply reaches a third drive time (see FIG. 7B); whereas, the determiner 124 determines that the sensing unit 260 is not normal when the ON signal from the sensor 64 is not received before that. The "third drive time" is a drive time of the supply pump 53 required to supply an amount of ink to the storage chamber 50, which amount is needed to store the predetermined amount of ink in the storage portion 163*a*.

The supply controller 123 controls the supply pump 53 so that ink is continuously supplied to the storage chamber 50 until the ON signal from the sensor 64 is continuously received for a predetermined detection time (see FIG. 7B). The "detection time" is a time period equal to or longer than a time period elapsing from a time point at which the float 62 is positioned in the first position by the ink supplied through the supply opening 51*a* and received by the receiver 163 to a time point the float 62 is away from the first position as a result of the fact that the ink stored in the storage portion 163*a* has flown out of the storage portion 163*a*.

Next, with reference to FIG. 8, description will be made for one example of operations of the liquid storage apparatus 40. The time point of the start of the operation flow of FIG. 8 is after the supply start determiner 122 determines to start the supply, and before the supply controller 123 starts the supply. In addition, at the time of the start, the controller 100 has not received the ON signal from the sensor 64 yet.

As shown in FIG. 8, first, the supply controller 123 drives the supply pump 53 with the supply valve 55 open, to start the supply (C1). Next, the determiner 124 determines whether the drive time of the supply pump 53 measured from the start of the supply has reached the third drive time (C2). When it is determined that the drive time has not reached the third drive time (C2: NO), the determiner 124 determines whether the ON signal from the sensor 64 has been received (C3). When it is determined that the ON signal from the sensor 64 has not been received (C3: NO), the determiner 124 returns the processing to C2. When it is determined that the ON signal from the sensor 64 has been received (C3: YES), the determiner 124 determines that the sensing unit 260 is normal. Thereafter, the determiner 124 determines whether the ON signal from the sensor 64 is continuously received for the detection time (C4). When it is determined that the ON signal is not continuously received for the detection time (C4: NO), the determiner 124 returns the processing to C2. When it is determined that the ON signal is continuously received for the detection time (C4: YES), the determiner 124 determines that the level of the ink stored in the storage chamber 50 has reached the first level. Then, the supply controller 123 stops the supply pump 53 to end the supply (C5), and this processing ends.

When it is determined that the drive time of the supply pump 53 measured from the start of the supply has reached the third drive time (C2: YES), the determiner 124 determines that the sensing unit 260 is not normal. Then, the supply controller 123 stops the supply pump 53 to stop the supply (C6). Next, the determiner 124 controls the display 95 so as to display thereon an image notifying a user that the sensing unit 260 is not normal (C7), and this processing ends.

As described above, in this embodiment, the amount of ink supplied to the storage chamber 50 is smaller, and ink is safely supplied to the storage chamber 50 until the float 62 is positioned in the first position by the ink stored in the storage chamber 50. Further, since ink is continuously supplied to the storage chamber 50, the time required for the supply is reduced.

Note that in the third embodiment, the receiver 163 is always vertically above the surface of the ink stored in the storage chamber 50; however, the receiver 163 may be vertically below the first level when the float is in the first position, as is in the second embodiment. In this case, similarly to the second embodiment, when the ON signal is not output from the sensor 64 despite the fact that ink whose amount is equal to or larger than the necessary amount has been supplied to the storage chamber 50 through the supply opening 51*a*, ink is kept supplied to the storage chamber 50. The determiner 124 determines that the sensing unit 160 is normal when the ON signal from the sensor 64 is received before the drive time of the supply pump 53 measured from the start of the supply reaches the second drive time; whereas the determiner 124 determines that the sensing unit 160 is not normal when the ON signal from the sensor 64 is not received before that. The shape of the receiver is not limited to that described in the above-described embodiments.

In the above-described embodiments, the float 62 is mounted on the end of the first arm 61*b*, which end is opposite to the shaft 61*a;* however, the present invention is not limited thereto as long as the float 62 is mounted on the first arm 61*b*. In the same way, the receiver 63 is mounted on the end of the second arm 61*c*, which end is opposite to the shaft 61*a;* however, the present invention is not limited thereto as long as the receiver 63 is mounted on the second arm 61*c*.

The sensor 64 is a magnetic sensor in the above-described embodiments; however, the present invention is not limited thereto as long as the sensor is capable of detecting whether the float 62 is in the first position. For example, the sensor may be an optical sensor. Alternatively, the sensor may include an encoder or the like provided to the shaft 61*a* to detect the rotational position of the rotating member 61, thereby detecting whether the float is in the first position.

The sensor 64 may be configured so that it is capable of detecting that the float 62 is in a position other than the first position based on a detected intensity of magnetic flux or the like. In this case, by controlling the supply pump 53 based on a detection result of the sensor 64, the supply controller 123 is able to cause the level of the ink stored in the storage chamber 50 to he a desired level between the first level and the second level.

The float 62 may be configured so that it is movable to a position vertically above the first position. That is, the rotating member 61 may be configured to rotate about the shaft 61*a* within a range between a rotational position corresponding to the float 62 being in the position vertically above the first position and the rotational position corresponding to the float 62 being in the second position. Even in this case, when ink whose amount is equal to or larger than the necessary amount is supplied through the supply opening 51*a*, the float 62 is positioned in the first position, or passes the first position, and therefore it is accurately determined whether the sensing unit is normal.

In the above-described embodiments, the sensor 64 detects the magnetic material included in the float 62; however, the sensor 64 may detect a magnetic material included in the receiver 63, 163. Also in this case, when the position of the receiver 63, 163 corresponds to the position of the float 62, it is possible to obtain the position of the float 62 by detecting the position of the receiver 63, 163 through the magnetic material.

In the above-described embodiments, a user is notified that the sensing unit is not normal by the image which indicates that information and is displayed on the display 95; however, the present invention is not limited thereto. For example, the user may be notified that the sensing unit is not normal by a sound output from a speaker or the like.

In the first and second embodiments, the determiner 124 is configured to determine whether the sensing unit is normal only once in one operation of the supply; however, the present invention is not limited thereto. For example, the determiner may he configured to make the above determination more than once in one operation of the supply. In the first and third embodiments, it may be determined that no ink is stored in the cartridge 30 mounted in the mounting portion 35 when, after it is determined that the sensing unit is normal at the time of starting the supply, the ON signal is not output from the sensor 64 during that supply despite the fact that ink is supplied to the storage chamber 50 through the supply opening 51*a*. Then, the display 95 may display thereon an image notifying a user of that information.

The controller 100 may include a single CPU, or a plurality of CPUs. Alternatively, the controller 100 may include a specific ASIC (application specific integrated circuit), or may include a combination of a CPU and a specific ASIC.

The present invention is applicable to a liquid storage apparatus which stores liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid storage apparatus, comprising:

a storage chamber configured to store liquid; and a sensing unit configured to detect an amount of stored liquid which is stored in the storage chamber, wherein, the storage chamber includes:

a supply opening which is formed on a wall defining the storage chamber and is configured to allow supplied liquid which is supplied to the storage chamber to pass therethrough; and a discharge opening which is formed on a wall defining the storage chamber and is configured to allow liquid discharged from the storage chamber to an outside of the storage chamber to pass therethrough;

the sensing unit includes:

a rotating member configured to rotate about a shaft in the storage chamber, the rotating member including a first arm extending in a first direction away from the shaft, and a second arm extending in a second direction which is away from the shaft and is different from the first direction;

a float which is mounted on the first arm, and is configured to float on a surface of the stored liquid;

a receiver which is mounted on the second arm and is positioned directly vertically below the supply opening from beginning to end of supply of liquid to the storage chamber, and is configured to receive the supplied liquid before the supplied liquid reaches the surface of the stored liquid; and a sensor configured to detect at least that the float is in a first position, and wherein, the rotating member is configured to rotate about the shaft at least within a range between a rotational position corresponding to the float being in the first position and a rotational position corresponding to the float being in a second position which is vertically below the first position, and the sensing unit is configured so that: (i) a direction of a first moment which is a moment about the shaft produced by self weights of the rotating member, the float, and the receiver is a direction in which the float is moved from the first position to the second position; and (ii) a direction of a resultant moment obtained by combining a second moment, which is a maximum moment about the shaft produced by kinetic energy of the supplied liquid colliding with the receiver when the receiver receives the supplied liquid, and the first moment is a direction in which the float is moved from the second position to the first position.

2. The liquid storage apparatus according to claim 1, further comprising:

a supplier configured to supply liquid to the storage chamber through the supply opening; and a determiner configured to determine whether the sensing unit is normal, wherein:

the sensing unit is configured to cause the receiver to be positioned vertically above the surface of the stored liquid when the float is positioned in the first position by the stored liquid; and the determiner is configured to determine that the sensing unit is normal when the sensor detects that the float is in the first position in response to an operation in which the supplier supplies a necessary amount of liquid to the storage chamber in a state where the sensor is not detecting that the float is in the first position, the necessary amount being an amount needed to produce the second moment, and the determiner is configured to determine that the sensing unit is not normal when the sensor does not detect that the float is in the first position in response to the operation.

3. The liquid storage apparatus according to claim 2, wherein:

the second moment is produced by kinetic energy of the supplied liquid;

the supplier is configured to supply liquid to the storage chamber until the float is positioned in the first position by the stored liquid; and when the sensor detects that the float is in the first position in response to the operation in which the supplier supplies the necessary amount of liquid to the storage chamber, the supplier is configured to intermittently supply liquid to the storage chamber thereafter until the sensor detects that the float is in the first position while the supplier does not supply liquid to the storage chamber.

4. The liquid storage apparatus according to claim 1, further comprising:

a supplier configured to supply liquid to the storage chamber through the supply opening; and a determiner configured to determine whether the sensing unit is normal, wherein:

the sensing unit is configured to cause the receiver to be positioned vertically below the surface of the stored liquid when the float is positioned in the first position by the stored liquid; and the determiner is configured to determine that the sensing unit is normal when the sensor detects that the float is in the first position in response to an operation in which the supplier supplies a necessary amount of liquid to the storage chamber in a state where the sensor is not detecting that the float is in the first position, the necessary amount being an amount needed to produce the second moment, and when the sensor does not detect that the float is in the first position in response to the operation, the supplier keeps supplying liquid to the storage chamber, and thereafter, when the sensor detects that the float is in the first position before an amount of the supplied liquid reaches a buffer amount, the determiner is configured to determine that the sensing unit is normal, whereas when the sensor does not detect that the float is in the first position before that, the determiner is configured to determine that the sensing unit is not normal, the buffer amount being an amount obtained by subtracting, from an amount of the stored liquid when the float is positioned in the first position by the stored liquid, a minimum amount among possible amounts of the stored liquid when the float is not moved to the first position due to contact of the receiver with the stored liquid despite the fact that the supplier supplies the necessary amount of liquid to the storage chamber.

5. The liquid storage apparatus according to claim 4, wherein:

the supplier is configured to supply liquid to the storage chamber until the float is positioned in the first position by the stored liquid; and when the sensor detects that the float is in the first position in response to the operation that the supplier supplies the necessary amount of liquid to the storage chamber, the supplier is configured to continuously supply liquid to the storage chamber thereafter from a time point at which the sensor no longer detects that the float is in the first position to a time point at which the sensor detects again that the float is in the first position.

6. The liquid storage apparatus according to claim 1, wherein:

the receiver includes a storage portion configured to temporarily store the supplied liquid;

the second moment is produced by a self weight of a predetermined amount of liquid stored in the storage portion and kinetic energy of the supplied liquid; and the receiver is configured to cause the liquid stored in the storage portion to flow out of the storage portion when the float is in the first position and the storage portion is vertically above the surface of the stored liquid.

7. The liquid storage apparatus according to claim 6, wherein the supplier is configured to continuously supply liquid to the storage chamber until the float is positioned in the first position by the stored liquid.

8. The liquid storage apparatus according to claim 1, wherein the sensing unit is configured to cause at least a part of the supplied liquid to reach the shaft when the float is in the second position.

9. A method of controlling a liquid storage apparatus comprising: a storage chamber configured to store liquid; and a sensing unit configured to detect an amount of stored liquid which is stored in the storage chamber, wherein, the storage chamber includes: a supply opening which is formed on a wall defining the storage chamber and is configured to allow supplied liquid which is supplied to the storage chamber to pass therethrough; and a discharge opening which is formed on a wall defining the storage chamber and is configured to allow liquid discharged from the storage chamber to an outside of the storage chamber to pass therethrough; the sensing unit includes: a rotating member configured to rotate about a shaft in the storage chamber, the rotating member including a first arm extending in a first direction away from the shaft, and a second arm extending in a second direction which is away from the shaft and is different from the first direction; a float which is mounted on the first arm, and is configured to float on a surface of the stored liquid; a receiver which is mounted on the second arm and is positioned directly vertically below the supply opening from beginning to end of supply of liquid to the storage chamber, and is configured to receive the supplied liquid before the supplied liquid reaches the surface of the stored liquid; and a sensor configured to detect at least that the float is in a first position, and wherein, the rotating member is configured to rotate about the shaft at least within a range between a rotational position corresponding to the float being in the first position and a rotational position corresponding to the float being in a second position which is vertically below the first position, the sensing unit is configured so that: (i) a direction of a first moment which is a moment about the shaft produced by self weights of the rotating member, the float, and the receiver is a direction in which the float is moved from the first position to the second position; and (ii) a direction of a resultant moment obtained by combining a second moment, which is a maximum moment about the shaft produced by kinetic energy of the supplied liquid colliding with the receiver when the receiver receives the supplied liquid, and the first moment is a direction in which the float is moved from the second position to the first position, and the sensing unit is configured to cause the receiver to be positioned vertically above the surface of the stored liquid when the float is positioned in the first position by the stored liquid, the method comprising the steps of:

(a) determining that the sensing unit is normal when the sensor detects that the float is in the first position in response to an operation in which a necessary amount of liquid is supplied to the storage chamber through the supply opening in a state where the sensor is not detecting that the float is in the first position, the necessary amount being an amount needed to produce the second moment; and (b) determining that the sensing unit is not normal when the sensor does not detect that the float is in the first position in response to the operation.

* * * * *